US005142122A

United States Patent [19]

Ariyama

[11] Patent Number: 5,142,122

[45] Date of Patent: Aug. 25, 1992

[54] FIXING DEVICE FOR IMAGE FORMING EQUIPMENT

[75] Inventor: Kenzo Ariyama, Yokohama, Japan

[73] Assignee: Ricoh Company, Ltd., Tokyo, Japan

[21] Appl. No.: 672,326

[22] Filed: Mar. 20, 1991

[30] Foreign Application Priority Data

Mar. 23, 1990 [JP] Japan ..... 2-71970

[51] Int. Cl.[5] ..... H05B 1/00; H05B 3/00

[52] U.S. Cl. ..... 219/216; 118/60; 355/284

[58] Field of Search ..... 355/283, 284, 282, 289, 355/290; 118/60, DIG. 1; 219/216

[56] References Cited

U.S. PATENT DOCUMENTS

| | | | |
|---|---|---|---|
| 3,748,035 | 7/1973 | Mannik | 355/327 X |
| 4,136,613 | 1/1979 | Namiki | 118/60 |
| 4,149,485 | 4/1979 | Okamoto et al. | 118/60 |
| 4,165,172 | 8/1979 | Okamoto et al. | 355/307 X |
| 4,254,732 | 3/1981 | Moser | 118/60 |
| 4,315,685 | 2/1982 | Inuzuki | 355/208 X |
| 4,352,551 | 10/1982 | Iwao | 118/60 X |
| 4,659,621 | 4/1987 | Finn et al. | 118/60 X |
| 4,720,731 | 1/1988 | Suzuki et al. | 355/256 X |
| 4,860,050 | 8/1989 | Kurotori et al. | 355/256 |
| 4,905,047 | 2/1990 | Ariyama | 355/256 |
| 4,905,049 | 2/1990 | Bickerstaff et al. | 355/284 |
| 4,948,691 | 8/1990 | Kurotori et al. | 430/99 |
| 4,985,733 | 1/1991 | Kurotori et al. | 355/256 X |
| 5,099,289 | 3/1992 | Kurotori et al. | 355/290 |

FOREIGN PATENT DOCUMENTS

| | | | |
|---|---|---|---|
| 58-79276 | 5/1983 | Japan | 355/307 |
| 0192037 | 11/1983 | Japan . | |
| 0124359 | 7/1984 | Japan | 355/246 |
| 0251074 | 10/1989 | Japan | 355/283 |

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

A fixing device applicable to image forming equipment and cable of controlling the amount of silicone oil to be applied to a heat roller. Silicone oil is applied to the heat roller via applicator felt, a second application roller and a first application roller. An upper and a lower scraper blade contact the surface of the second application roller to regulate the silicone oil on the second application roller to a predetermined small amount. While one of the scraper blades so regulates the amount of silicone oil on the second application roller, the other scrapes offset toner particles, paper dust and other impurities off the application roller.

4 Claims, 5 Drawing Sheets

FIXING DEVICE FOR IMAGE FORMING EQUIPMENT

BACKGROUND OF THE INVENTION

The present invention relates to a fixing device for an electrophotographic copier, laser printer, facsimile transceiver or similar image forming equipment and, more particularly, to a fixing device capable of controlling the amount of silicone oil to be applied to a heat roller thereof.

A fixing device incorporated in image forming equipment such as an electrophotographic copier has a heat roller having a heater thereinside, a press roller contacting the heat roller, and a piece of felt for applying silicone oil to the heat roller. A prerequisite with this type of fixing device is that silicone oil be applied in as small an amount as possible and in a uniform distribution to the surface of the heat roller. To meet this requirement, a piece of felt or similar stationary member may be held in contact with the surface of the heat roller, as customary in the art. This traditional scheme, however, increases the torque for driving the heat roller and is apt to damage the stationary member and roller to reduce their service life. In the light of this, a system of the type using a plurality of rollers for applying silicone oil to the heat roller is predominant today. This predominant type of system has a first application roller contacting the heat roller for applying silicone oil thereto, a second application roller contacting the first roller, and an oil reservoir storing silicone oil. A piece of felt is immersed in the silicone oil in the reservoir at one end thereof and held in contact with the surface of the second application roller at the other end thereof. A cleaning and oil collecting roller cleans the heat roller to collect the silicone oil. A scraper blade scrapes offset toner particles, paper dust and other impurities off the surface of the cleaning and oil collecting roller.

The conventional fixing device described above lacks means for controlling the amount of silicone oil to be applied to the second application roller, i.e., for regulating the silicone oil fed from the felt to the second application roller to a predetermined small amount. Specifically, the silicone oil fed to the application roller is directly transferred to the other application roller and then to the heat roller. Assume that paper sheets of relatively small size such as format A4 are successively passed through between, for example, the heat roller and press roller. Then, a necessary amount of silicone oil is successfully applied and consumed in a surface portion of the heat roller which the paper sheet passes. However, in the other surface portion of the heat roller 1 where the paper sheet does not exist, the silicone oil is applied to the heat roller in the maximum amount with which the felt can be impregnated. When a paper sheet of relatively large size such as format A3 arrives at the first fixing section while an excessive amount of silicone oil exists in the particular surface portion of the heat roller as mentioned above, a strip-like area of the paper sheet of format A3 corresponding to the above-mentioned surface portion of the heat roller is contaminated.

SUMMARY OF THE INVENTION

It is therefore an object of the present invention to provide a fixing device for image forming equipment which is capable of controlling the amount of silicone oil to be applied to a heat roller.

It is another object of the present invention to provide a generally improved fixing device for image forming equipment.

A fixing device for fixing an image transferred to a recording medium of the present invention comprises a rotatable heat roller, a first press roller rotatable in contact with the heat roller, a first rotatable application roller contacting the heat roller for feeding silicone oil to the heat roller, a second rotatable application roller contacting the first application roller for applying silicone oil to the first application roller, applicator felt contacting the second application roller for applying the silicone oil to the second application roller, and an upper and a lower scraper blade holding the applicator felt therebetween and contacting the second application roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, the problem particular to the conventional fixing devices will be described specifically.

What is most important concerning the application of silicone oil conventionally practiced with a fixing device is how to apply it in a small amount and in a uniform distribution to the surface of a heat roller. It has been customary to apply silicone oil to the surface of a heat roller by a piece of felt or similar stationary member which is impregnated with silicone oil and held in contact with the roller. This traditional scheme, however, increases the torque for driving the heat roller and is apt to damage the stationary member and roller to reduce their service life. In the light of this, a system of the type using a plurality of rollers for applying silicone oil to the heat roller is predominant today, as will be described with reference to FIG. 4.

Figure 4:
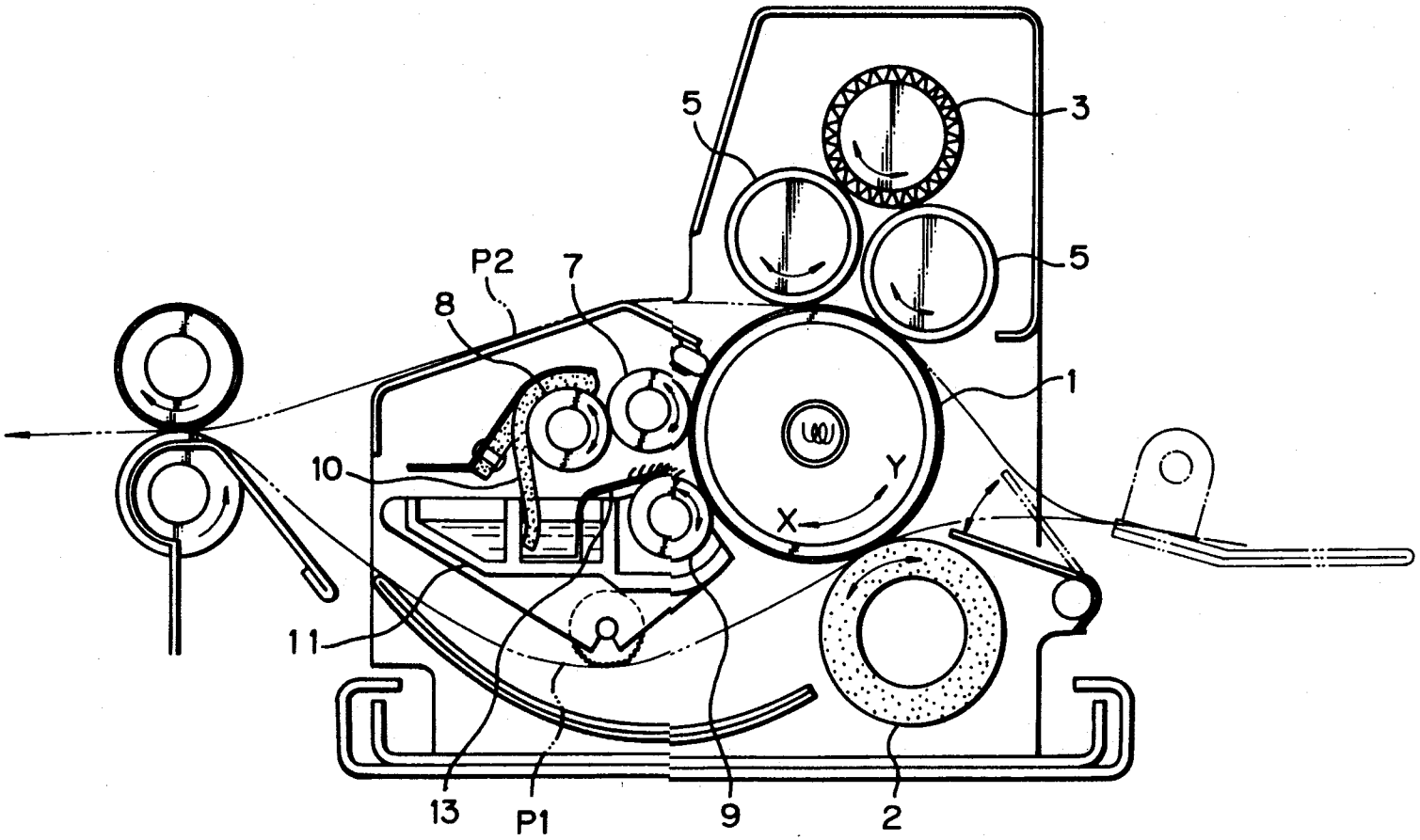
Fig. 4 PRIOR ART
FIG. 4 is a sectional side elevation showing a conventional fixing device.

As shown in FIG. 4, a plurality of press rollers 5 and a single press roller 2 are rotatable in contact with different points of the surface of a heat roller 1. The press roller 2 and heat roller 1 define a first fixing section while the press rollers 5 and heat roller 1 define a second fixing section. The heat roller 1 is selectively rotatable clockwise and counterclockwise as indicated by arrows X and Y in the figure. Specifically, the heat roller 1 is rotated in the direction X to fix a plain paper sheet P1 in the first fixing section or in the direction Y to fix a special paper sheet P2 in the second fixing section. A first application roller 7 is held in contact with the surface of the heat roller 1, and a second application roller 8 is held in contact with the surface of the application roller 7. A piece of felt 10 remains in contact with the surface of the second application roller 8 and has a lower portion thereof immersed in silicone oil which is stored in a reservoir 11. The reference numeral 9 designates a roller for cleaning the heat roller 1 while collecting silicone oil therefrom. A scraper blade is held in contact with the surface of the cleaning and oil collecting roller 9 to scrape toner particles, paper dust and other impurities off the roller 9. The reference numeral 3 designates a cleaning roller.

Figure 5:
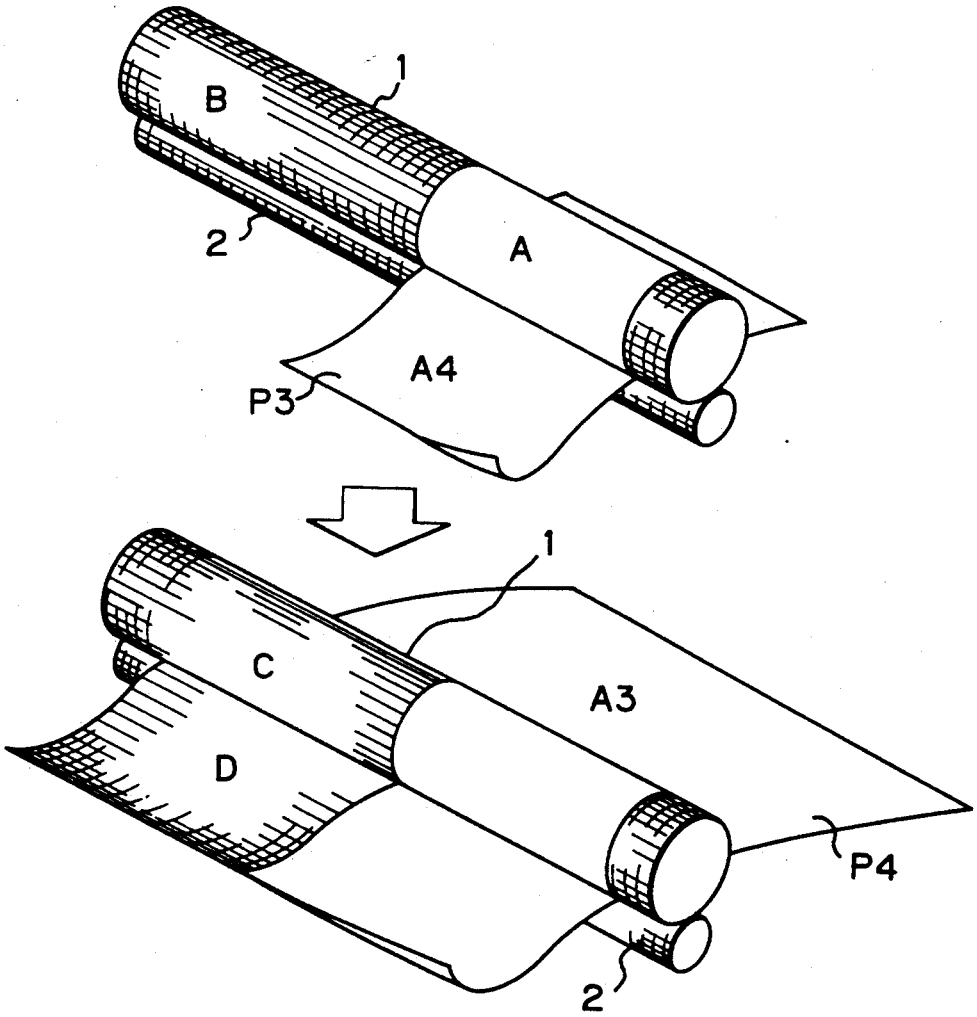
Fig. 5 PRIOR ART
FIG. 5 is a perspective view useful for understanding why the conventional fixing device contaminates a paper sheet when the paper size is changed.

The conventional fixing device described above lacks means for regulating the silicone oil fed from the felt 10 to the second application roller 8 to a predetermined small amount. Specifically, the silicone oil fed to the application roller 8 is directly transferred to the other application roller 7 and then to the heat roller 1. As shown in FIG. 5, assume that paper sheets P3 of relatively small size such as format A4 are successively passed through, for example, the first fixing section defined by the heat roller 1 and press roller 2. Then, a necessary amount of silicone oil is successfully applied and consumed in a surface portion A of the heat roller 1 which the paper sheet P3 passes. However, in the other surface portion B of the heat roller 1 where the paper sheet P3 does not exist, the silicone oil is applied to the heat roller 1 in the maximum amount with which the felt 10 can be impregnated. When a paper sheet P4 of relatively large size such as format A3 arrives at the first fixing section while an excessive amount of silicone oil exists on the surface portion B as mentioned above, a strip-like area D of the paper sheet P4 which passes the surface portion C corresponding to the width of the paper sheet P4 is contaminated in the surface portion B of the heat roller 1.

Figure 1:
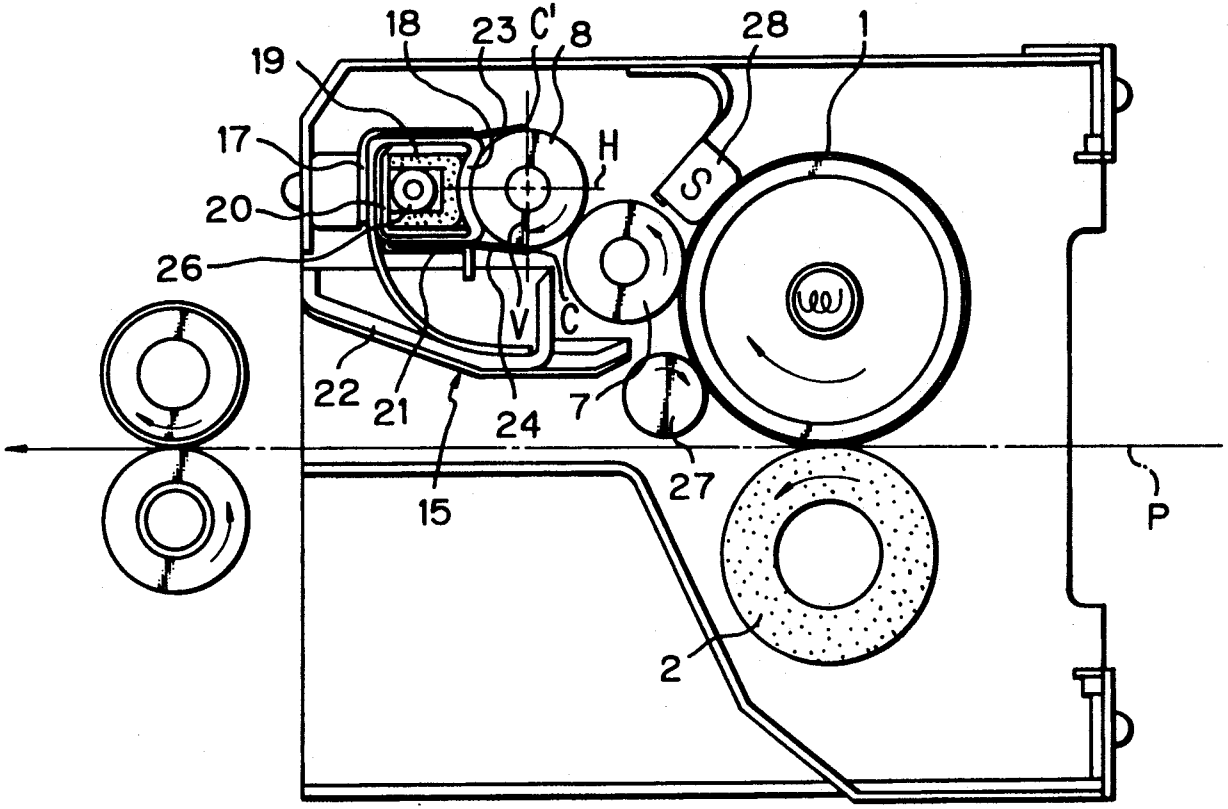
FIG. 1 is a sectional side elevation of a fixing device embodying the present invention.
Figure 2:
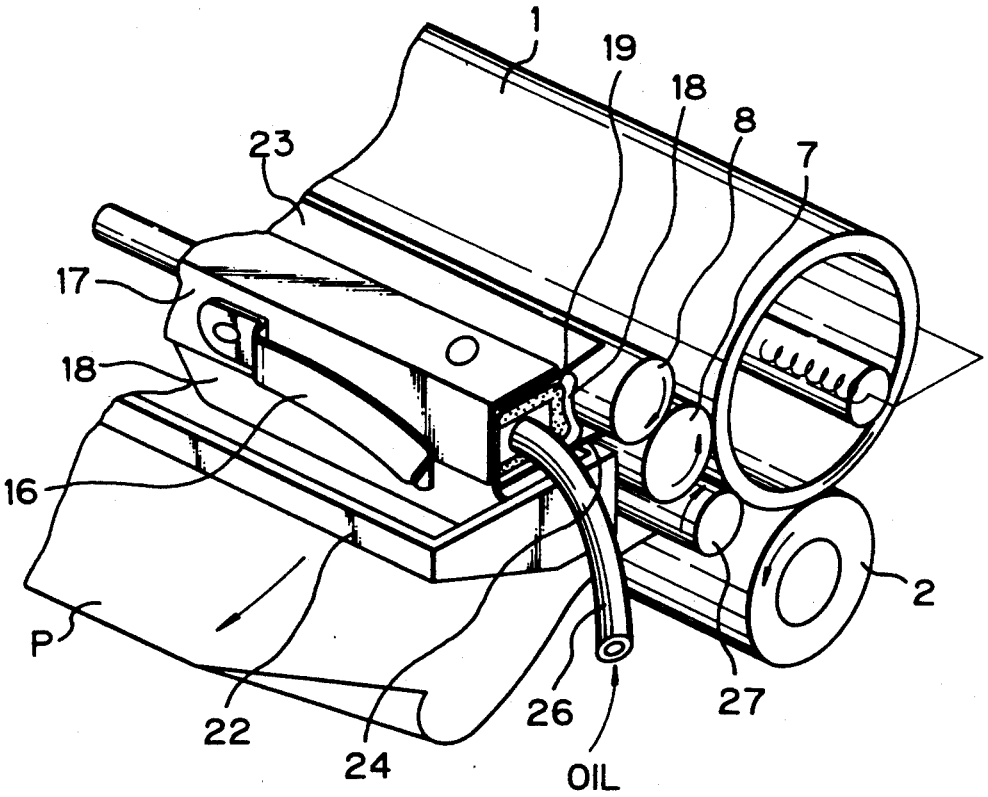
FIG. 2 is a fragmentary perspective view of the embodiment.

Referring to FIGS. 1 and 2, a fixing device embodying the present invention is shown. In these figures, the components similar to those shown in FIGS. 4 and 5 are designated by the same reference numerals. As shown in FIG. 1, the fixing device has an application unit 15 which includes a first and a second application roller 7 and 8 and an oil receiver which will be described. The application unit 15 is removably mounted on the fixing device from the front end of the latter as viewed in FIG. 1. As shown in FIG. 2, a leaf spring 16 for implementing such a manner of mounting of the application unit 15 is affixed to the surface of a generally L-shaped retainer plate 17 which retains a piece of felt or applicator felt 18. The felt 18 is held in contact with the surface of the second application roller 8. Another piece of felt 19 is configured in the form of a letter U and held in contact with the rear surface of the felt 18. The U-shaped felt 19 is accommodated in a retainer plate 20 which is also generally U-shaped and opposite in position to the felt 19. The applicator felt 8 wraps around the retainer plate 20 and felt 19 by more than one turn. One side of the applicator felt 18 that contacts the felt 19 is held in contact with the application roller 8. The bottom of the applicator felt 18 is retained by the retainer plate 20 and a retainer plate, while the top and the side opposite to the above-mentioned side of the applicator felt 18 are retained by the retainer plates 17 and 20. The free end of the applicator felt 18 is bent downward into an oil receiver 22 via the clearance between the retainer plates 17 and 21.

Scraper blades 23 and 24 are held in contact with the surface of the application roller 8. Referring to FIG. 1, the lower scraper blade 24 contacts the application roller 8 at a contact point C which is substantially on the vertical line V passing through the rotational center of the roller 8, the contact point C being below the horizontal line H passing through the rotational center of the roller 8. Conversely, the upper scraper blade 23 contacts the roller 8 at the contact point C' which lies substantially on the vertical line V, but above the horizontal line H. During the operation for affixing the applicator felt 18 to the retainer plates 17, 20 and 21, the ends of the scraper blades 23 and 24 which are remote from the roller 8 are respectively affixed to between the retainer plates 17 and 20 and between the retainer plates 21 and 20 above and below the applicator felt 18. The scraper blades 23 and 24 each may be implemented as by a thin sheet of heat-resistive and resilient metal such as phosphor bronze. A tube 26 extends from a source of silicone oil supply, not shown, to the interior of the U-shaped felt 19 to feed silicone oil to the felt 19. The silicone oil fed to the felt 19 is transferred to the applicator felt 18. The reference numerals 27 and 28 designate a separation roller and a thermistor 28, respectively. The separation roller 27 is a specific form of paper separating means and may alternatively be implemented as a pawl.

In operation, the silicone oil fed to the felt 19 by the tube 26 is transferred from the felt 19 to the applicator felt 18 and further to the second application roller 8 which contacts the applicator felt 18. The upper scraper blade 23 regulates the silicone oil on the roller 8 to a predetermined small amount. Such a regulated amount of silicone oil is applied to the surface of the heat roller 1 via the first application roller 7. The excessive silicone oil removed by the blade 23 is collected in the oil receiver 22 via the applicator felt 18. During the application of the silicone oil, offset toner particles, paper dust and other impurities deposited on the heat roller 1 are transferred to the application roller 8 via the application roller 7. These impurities are scraped off the application roller 8 by the lower scraper blade 24 and let fall into the oil receiver 22.

Figure 3:
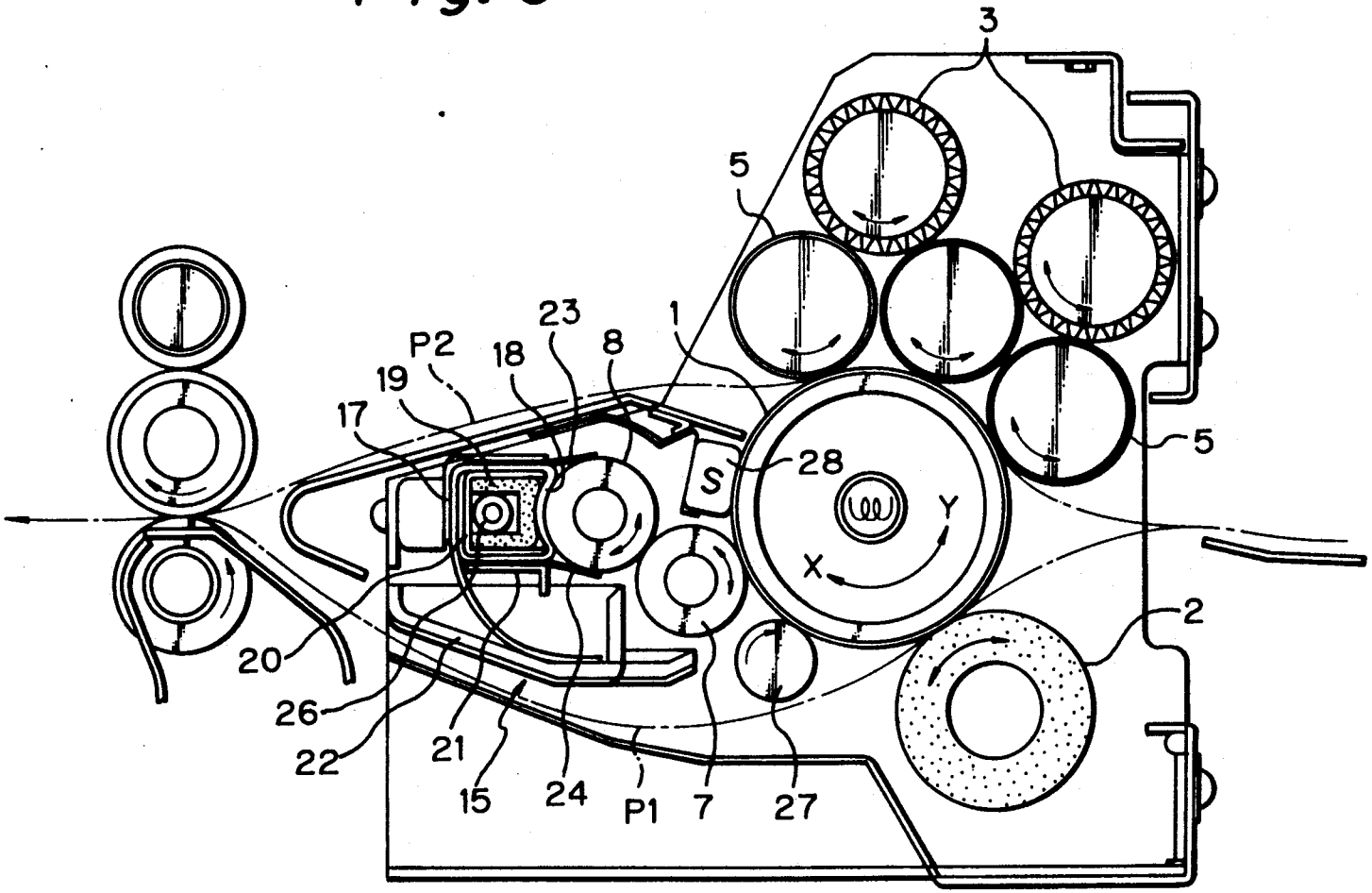
FIG. 3 is a sectional side elevation showing an alternative embodiment of the present invention.

Referring to FIG. 3, an alternative embodiment of the present invention will be described. As shown, while this embodiment also has the application unit 15, it is different from the previous embodiment in that the fixing section where the application unit 15 is located is made up of a first and a second fixing section, as in the prior art device shown in FIG. 4. Hence, the components similar to those shown in FIGS. 1 and 4 are designated by the same reference numerals, and redundant description will be avoided for simplicity. In this embodiment, the application rollers 7 and 8 each is reversible, as indicated by a double headed arrow in the figure. When the application roller 8 is rotated counterclockwise, the lower scraper blade 24 regulates the silicone oil on the roller 8 to a predetermined small amount while the upper scraper blade 23 scrapes offset toner particles and other impurities off the roller 8.

In summary, in accordance with the present invention, silicone oil is applied to a heat roller in a predetermined small amount as regulated by either one of an upper and a lower scraper blade which contact the surface of an application roller. As a result, even a paper sheet of relatively large size is free from contamination when substituted for a paper sheet of relatively small size. This advantage is attainable if only part of a conventional arrangement is modified and, therefore, at low cost. While one of the scraper blades so regulates the amount of silicone oil on the application roller, the other scrapes offset toner particles, paper dust and other impurities off the application roller. This is successful in increasing the service life of applicator felt.

Various modifications will become possible for those skilled in the art after receiving the teachings of the present disclosure without departing from the scope thereof. For example, the applicator felt 18 and felt 19 physically independent of each other may be constituted by a single felt member, if desired.

What is claimed is:

1. A fixing device for fixing an image transferred to a recording medium, comprising:

a rotatable heat roller;

a first press roller rotatable in contact with said heat roller;

a first rotatable application roller contacting said heat roller for feeding silicone oil to said heat roller;

a second rotatable application roller contacting said first application roller for applying silicone oil to said first application roller;

applicator felt contacting said second application roller for applying the silicone oil to said second application roller; and an upper and lower scraper blade holding said applicator felt therebetween and contacting said second application roller, said lower scraper blade contacting said second application roller at a contact point being below a horizontal line passing through the rotational center of said second roller, wherein one of said upper scraper blade and said lower scraper blade regulates the silicone oil applied to said second application roller to a predetermined amount, while the other scrapes off impurities transferred from said heat roller to said second application roller.

2. A device as claimed in claim 1, further comprising a plurality of second press rollers contacting said heat roller at a position different from said first press roller and rotatable in contact with said heat roller, said heat roller and said first press roller defining a first fixing section while said heat roller and said second press rollers defining a second fixing section.

3. The fixing device of claim 1 wherein said upper scraper blade is positioned above said horizontal line.

4. The fixing device of claim 3, wherein said upper and lower scraper blades contact said second application roller at upper and lower contact points substantially on a vertical line passing through said rotational center of said second application roller.

* * * * *